US007367515B1

(12) United States Patent
Newman

(10) Patent No.: US 7,367,515 B1
(45) Date of Patent: May 6, 2008

(54) DEVICE FOR APPLYING MARKS TO A PLAYING FIELD

(76) Inventor: Ralph R. Newman, 5151 Ironton Way, Englewood, CO (US) 80111

( * ) Notice: Subject to any disclaimer, the term of this patent is extended or adjusted under 35 U.S.C. 154(b) by 0 days.

(21) Appl. No.: 11/494,981

(22) Filed: Jul. 27, 2006

(51) Int. Cl.
*B05B 1/28* (2006.01)
*A01C 1/00* (2006.01)
*B60P 3/22* (2006.01)

(52) U.S. Cl. ..... 239/150; 239/172; 239/444; 222/608; 222/612; 404/93; 404/94

(58) Field of Classification Search ..... 239/150, 239/172, 444, 441, 124, 126, 175, 176, 288, 239/288.3; 401/137; 404/93, 94, 83; 222/608, 222/612, 611.1, 610, 617
See application file for complete search history.

(56) References Cited

U.S. PATENT DOCUMENTS

| | | | | |
|---|---|---|---|---|
| 2,086,673 | A | 7/1937 | Johnson | |
| 2,812,211 | A | 11/1957 | Gardner | |
| 3,052,077 | A | 9/1962 | Gustafson et al. | |
| 3,239,147 | A | 3/1966 | Sweet | |
| 3,352,283 | A | 11/1967 | Maus | |
| 4,345,544 | A | 8/1982 | Besecker | |
| 4,442,975 | A | 4/1984 | Long et al. | |
| 4,624,602 | A * | 11/1986 | Kieffer et al. | 404/94 |
| 4,793,559 | A * | 12/1988 | Marlek | 239/722 |
| 4,893,751 | A * | 1/1990 | Armstrong | 239/150 |
| 5,302,207 | A * | 4/1994 | Jurcisin | 118/713 |
| 6,036,123 | A * | 3/2000 | West | 239/750 |
| 6,062,443 | A | 5/2000 | Smrt | |
| 7,021,860 | B1 * | 4/2006 | Bolstad | 404/94 |
| 7,118,629 | B2 * | 10/2006 | Davidson | 118/323 |
| 7,150,413 | B1 * | 12/2006 | Bricko et al. | 239/150 |
| 2002/0175221 | A1 | 11/2002 | Roman | |

OTHER PUBLICATIONS

"Marking your spot (Product Roundup: Products and Services From Suppliers)", Parks & Recreation, Sep. 1, 2005, p. 140.*

* cited by examiner

*Primary Examiner*—Dinh Q. Nguyen
*Assistant Examiner*—James S. Hogan
(74) *Attorney, Agent, or Firm*—Donald W. Margolis

(57) ABSTRACT

An auxiliary device for marking marks on a surface of a field playing surface. The device includes a frame attachable to a field line marking machine that includes a paint supply. A guide system having a length dimension is carried by the frame member. The guide system is oriented horizontally. A field paint coating apparatus is carried within the guide system carried by the frame member for movement over a fixed distance along the guide system. The field paint coating apparatus is connected to the paint supply carried by the field line marking machine and serves to paint marks accurately, precisely and reproducibly on a field playing surface.

20 Claims, 4 Drawing Sheets

DEVICE FOR APPLYING MARKS TO A PLAYING FIELD

BACKGROUND OF THE INVENTION

1. Field of the Invention

This invention relates generally to a device for spraying or projecting a coating for use in forming a layout for an athletic playing field or court surface, and to methods for using such a device. More particularly, the invention relates to such a marking device for accurately applying two or more hash marks to a football field.

2. Description of the Prior Art

Most types of athletic playing fields and courts must have marking lines applied thereto for laying out boundaries and areas or regions of the field or court. In addition, under league regulations, football fields are required to have both five yard line markers, but also to have markers called "hash marks" at one yard intervals between the five yard line markers over the entire length of each side of the field. Hash marks for U.S. professional and college football fields are currently required to be precisely twenty-four (24") inches in length, and are to be located four (4") inches from each sideline. Some high school football fields have similarly spaced twenty-four (24") inch hash marks that actually begin at and extend from the two sidelines.

While conventional coating devices for forming the long sidelines boundaries and the long five yard line markers across a football field are known in the art, such conventional devices are quite bulky and cumbersome to use. Due to the short length of each hash mark, using such devices to form hash marks at specific locations and to precise specifications on a field is not practical. In the known prior and current art, hash marks have been and are usually produced using templates and stencils. Of necessitaty, templates and stencils require multiple persons to handle, place, and then manually coat the material to form each hash mark, or a series of two or more hash marks, on the field at the obligatory one yard intervals and with therequired dimensions. The current method of forming hash marks requires an inordinate amount of time and person power. In addition, manually forming the hash marks often leads to inaccuracies in their size and placement.

Accordingly, there exists a need for a device for accurately, precisely and reproducibly applying hash marks to a football field playing surface, which device requires only a single person to accurately place two or more hash marks in their required location. Additionally, a need exists for a device and method for coating hash marks on a football field surface which device and method are both easy to use and accurate.

SUMMARY OF THE INVENTION

The device and method of the present invention provides a system for marking hash marks of a predetermined length, and, preferably at a predetermined position, on the surface of a football playing field. The hash marking device comprises a frame member designed to be attached to any current or future state-of-the-art field marking machine that carries a paint supply. In preferred embodiments, when such a frame member is so attached to a marking machine it will be in a substantially horizontal position, above and out of contact with the to-be-marked field. The frame member carries a guide system which is also horizontally oriented, and the guide system in turn carries a field paint coating apparatus. The field paint coating apparatus is carried by the field marking machine, and is slidably secured to the guide system carried by the frame system for controlled movement over a predetermined distance from a first position to a second position up and back along the guide system.

As noted above, the field paint coating apparatus is in fluid communication with the paint supply so that the field paint coating apparatus is capable of controllably dispensing paint, in the form of an accurately located precisely sized hash mark at predetermined locations on a football field. In preferred embodiments, the field paint coating apparatus is in fluid communication with the paint supply container through a flexible tube for controllably dispensing paint as a hash mark of a predetermined length, and, preferably at a predetermined position, on the surface of a football playing field.

The present invention further includes a method for painting hash marks at predetermined locations on a surface of a football field. The method comprises providing a hash marking device having a horizontal guide system and carrying a field paint spray apparatus secured to a movable field marking machine having a paint supply. The field paint coating apparatus is placed in fluid communication with the paint supply, activating the movement of paint from the paint supply to the field paint coating apparatus, and moving the field paint coating apparatus along the guide system a predetermined distance to paint a hash mark at a predetermined location on the surface of a football field.

In preferred systems a mechanism is provided for controlling the width of the painted hash marks, and this is preferably provided by a system for raising or lowering the field paint coating apparatus of the system, although the width of the painted hash marks may be controlled with valves or other mechanisms at the dispensing portion of field paint coating apparatus.

In preferred embodiments the hash marker device of the present invention is attachable to and removable from a state-of-the art field marker system. For example, the field line marker machine with which the hash marking device of the present invention is shown and discussed in this application is manufactured by Newstripe, Inc., Aurora, Colo. The field marker system shown has four wheels and is power driven for use as a five yard line marker and a side line striper. It carries a pressurized paint container. However, it is within the scope of the present invention to utilize any type of field marking device. So for example, a simple walk behind hand pushed gravity fed field paint marking device may be adapted to carry the hash line marking device of the present invention. Similarly, the hash line marking device of the present invention may be integral with a field marking device or a paint dispenser of any design.

As noted herein, in preferred usage, the state-of-the-art field marking machine carries a pressurized container for a paint supply, but other forms of paint supply, including gravity feed and aerosol containers may be used with the hash marking device of the present invention. While the system shown and discussed is a wet paint dispensing system, as used herein, "paint" shall mean any fluent dispensable material, whether wet or dry and of any color. Similarly, a "football" field may be any playing field or court, and a "hash mark" may be any relatively short precisely dimensioned mark on any field or court.

DETAILED DESCRIPTION. OF THE PREFERRED EMBODIMENTS

Figure 1:
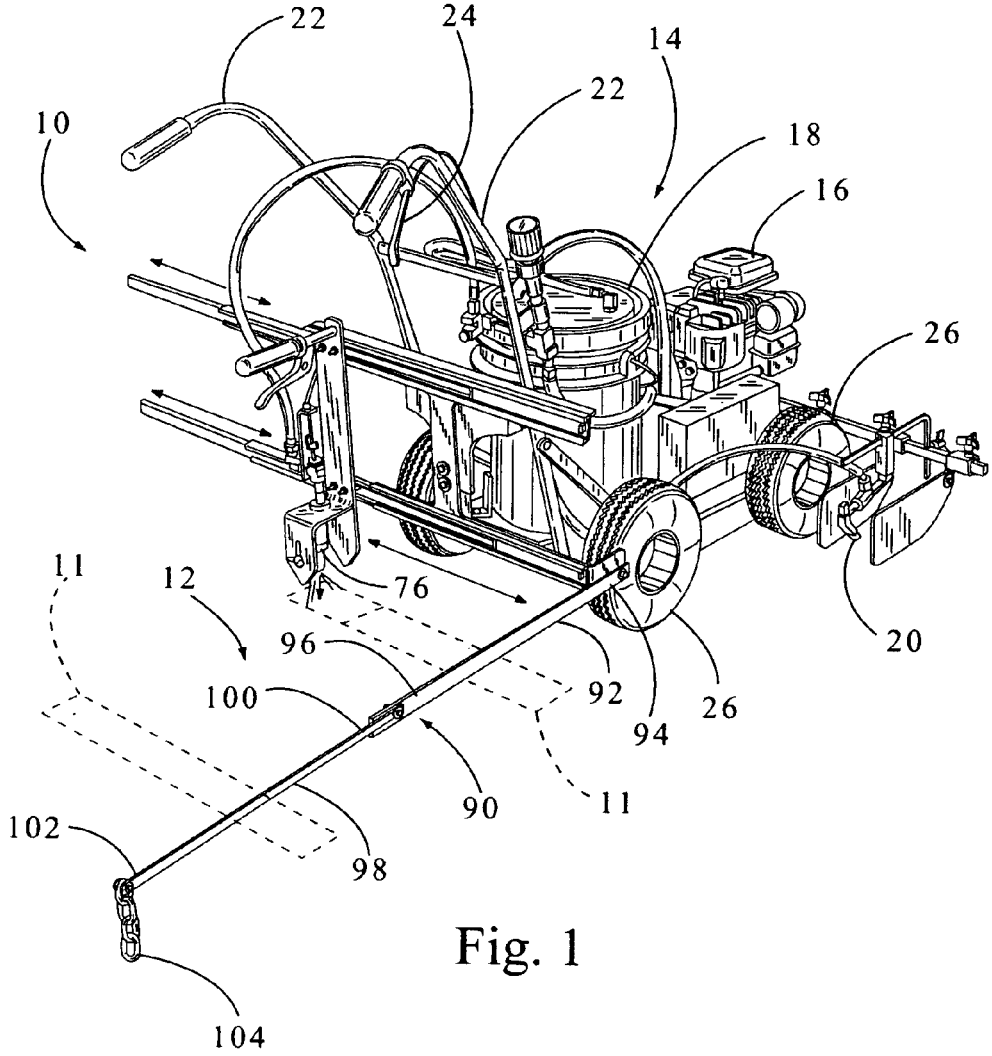
FIG. 1 is a right rear perspective view illustrating a marking device for applying a hash mark, shown throughout in phantom, to a surface, constructed in accordance with the present invention, with the marking device connected to a field marking machine.

As illustrated in FIG. 1, the present invention is a marking device, indicated generally at 10, for applying a hash mark 11, shown in phantom, to a surface 12. In a preferred embodiment, marking device 10 of the present invention is releasably securable to a state-of-the-art field marking machine 14. In the embodiment shown the field marking machine 14 includes an engine 16 for pressurizing a paint supply 18 and providing power to field marking machine 14, a device 20 for spraying a paint on surface 12, a plurality of handle members 22 for steering field marking machine 14, a paint control lever 24 on one of handle members 22, and wheels 26 for allowing easy movement of field marking machine 14 along the surface.

When field marking machine 14 is powered, activation of the paint control lever 24 causes engine 16 to pressurize the paint supply 18 causing paint from the paint supply 18 to travel through device 20 onto surface 12. While marking device 10 of the present invention has been described and illustrated herein as being securable to a particular field marking machine 14, i.e., a field wet line marker manufactured by Newstripe, Inc., Aurora, Colo., it is within the scope of the present invention to utilize marking device 10 on any type of field marking machine 14.

Figure 5:
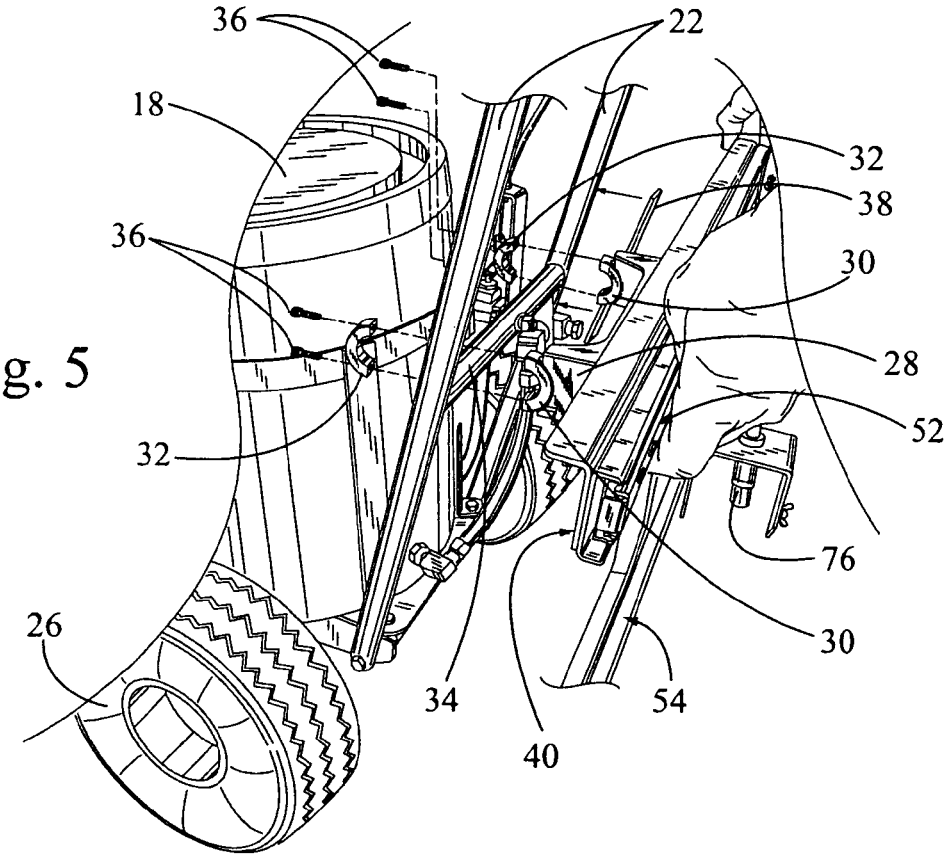
FIG. 5 is a left rear partially broken away perspective view illustrating the marking device for applying hash marks to a surface, constructed in accordance with the present invention, and showing the marking device separated from and prior to connection with the field marking machine.

As illustrated in FIG. 5, marking device 10 of the present invention includes a frame member 28 releasably securable to handle members 22. Frame member 28 has a pair of U-shaped connections 30 mounted thereon and receivable about a support bar 34 between handle members 22. A complementary U-shaped link 32 is secured to each of the U-shaped connections 30 by, for example, a plurality of screws 36. The U-shaped connections 30 and U-shaped links 32 completely surround support bar 34 thereby firmly securing frame member 28 of marking device 10 to field marking machine 14.

In addition, frame member 28 of marking device 10 of the present invention includes a stabilizing plate 38 adjacent one of U-shaped connections 30. When frame member 28 is secured to field marking machine 14, the stabilizing plate 38 is positioned directly against one of handle members 22. The stabilizing plate 38 serves to inhibit rotation of frame member 28 relative to handle members 22 maintaining frame member in the desired position.

Figure 6:
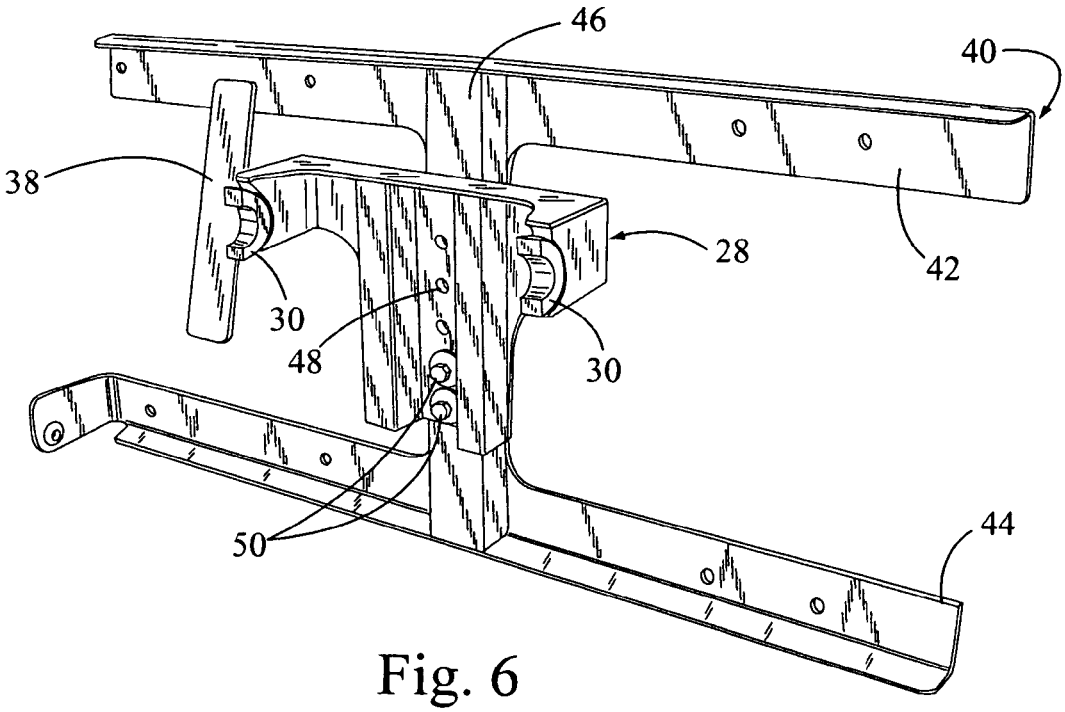
FIG. 6 is a further enlarged right rear perspective view illustrating the details of a frame member of the marking device for applying hash marks to a surface, constructed in accordance with the present invention.

As best illustrated in FIG. 6, marking device 10 further includes a support member 40 releasably secured to frame member 28. The support member 40 includes a first cross member 42, a second cross member 44, and a central connecting member 46 secured between first cross member 42 and second cross member 44. The central connecting member 46 of support member 40 includes a plurality of linearly aligned apertures (not shown). In addition, frame member 28 includes a plurality of linearly aligned apertures 48. Preferably, support member 40 is secured to frame member 28 by a plurality of bolts 50 insertable through the aligned apertures on both frame member 40 and support member 28 with nuts (not shown) tightened thereon for maintaining support member 40 to frame member 28.

As best illustrated in FIGS. 5 and 6, by moving support member 40 in a generally upward or downward direction, aligning the apertures, and inserting bolts 50 through the desired apertures can adjust the height of support member 40 relative to frame member 28. Tightening of nuts on bolts 50 releasably secures the support member to the frame member at the preferred desired height. Depending on the type of field marking machine 14 used with marking device 10 of the present invention, the height of support member 40 relative to frame member 28 may be adjusted to create a four (4") inch wide hash mark 11 on surface 12. The method of spraying hash mark 11 on surface 12 is explained in further detail below.

Figure 2:
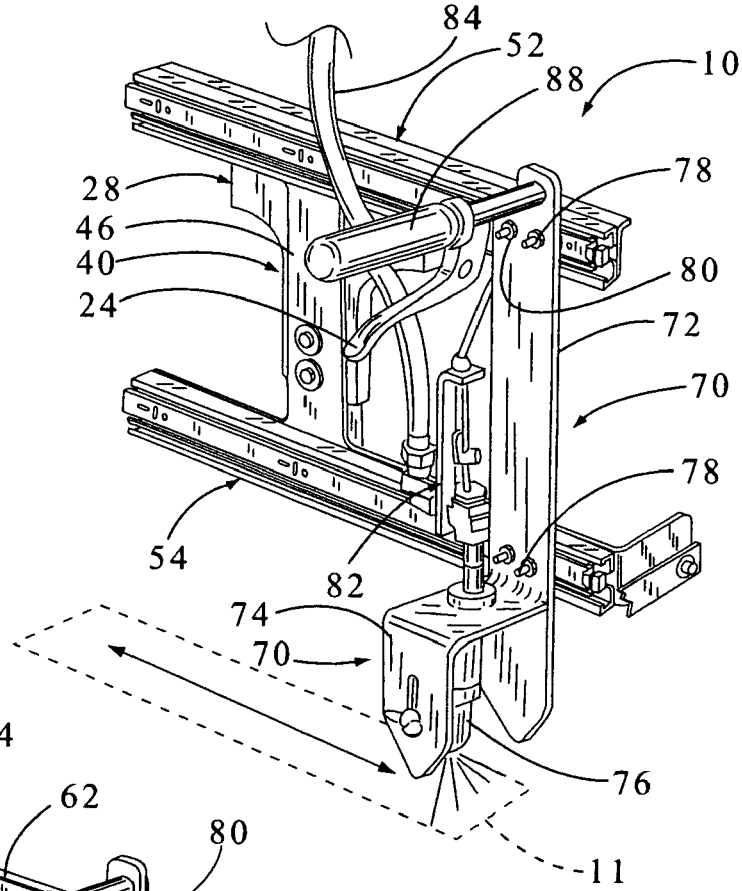
FIG. 2 is an enlarged perspective view illustrating the marking device for applying hash marks to a surface, constructed in accordance with the present invention, with the marking device in its far right travel distance.
Figure 3:
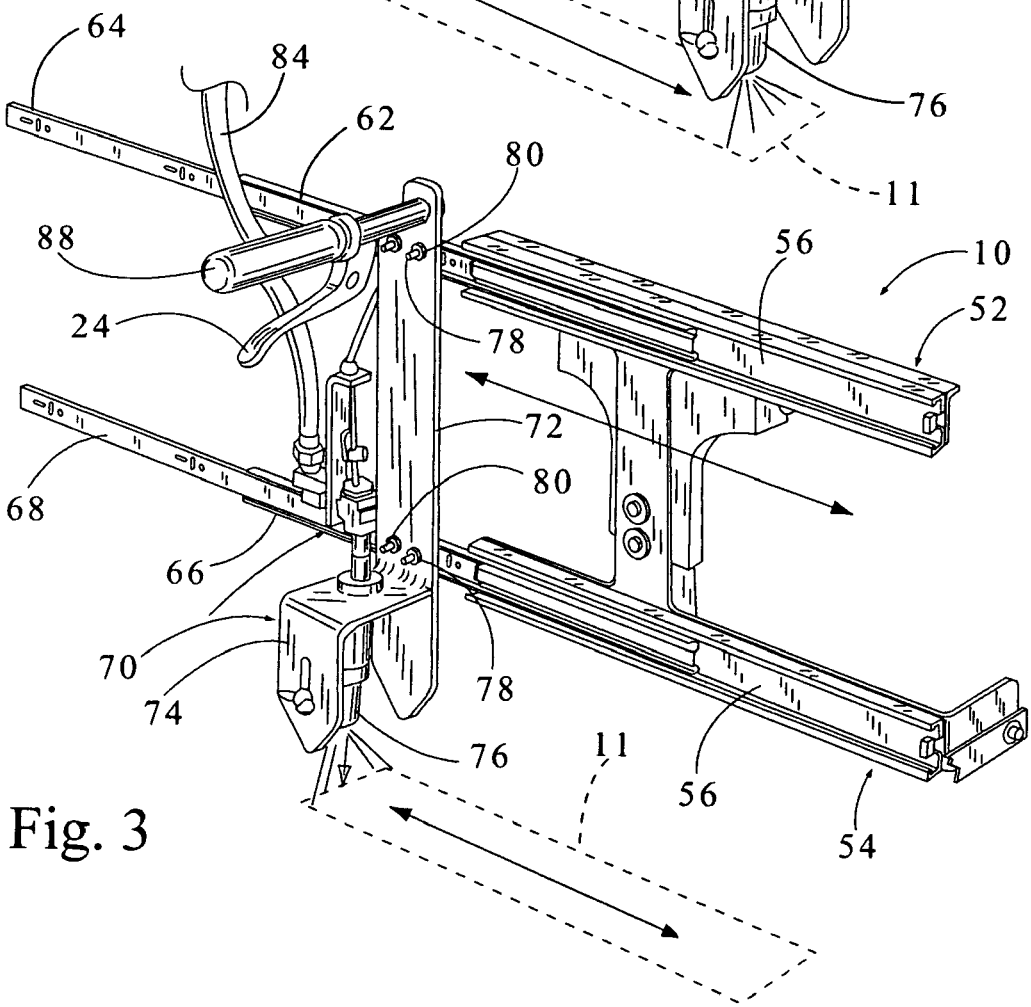
FIG. 3 is a perspective view similar to FIG. 2, and illustrating the marking device for applying hash marks to a surface, constructed in accordance with the present invention, with the marking device in its far left travel distance.
Figure 4:
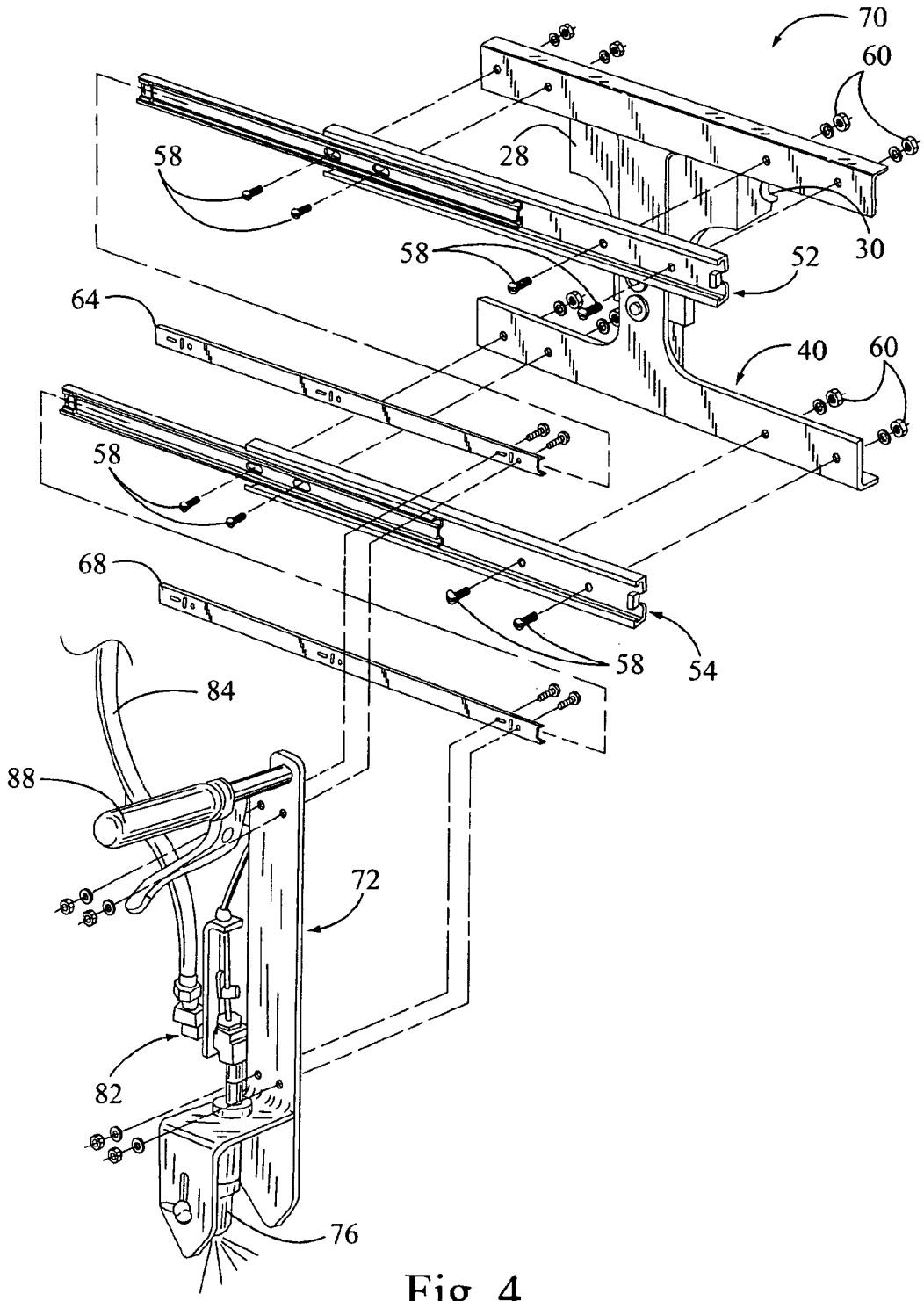
FIG. 4 is an exploded perspective view of the system of FIG. 3, and illustrating one embodiment of the marking device for applying hash marks to a surface, constructed in accordance with the present invention.

As best illustrated in FIGS. 2-4, marking device 10 of the present invention further includes a first rail apparatus 52 secured to first cross member 42 and a second rail apparatus 54 secured to second cross member 44. The first rail apparatus 52 and second rail apparatus 54 of marking device 10 each include a main guide rail 56. Attachment of first rail apparatus 52 and second rail apparatus 54 to first cross member 42 and second cross member 44, respectively, is accomplished by bolts 58 extending through main guide rails 56 of first rail apparatus 52 and second rail apparatus 54 and first cross member 42 and second cross member 44, respectively. Tightening of corresponding nuts 60 on bolts 58 releasably secures first rail apparatus 52 to first cross member 42 and second rail apparatus 54 to second cross member 44.

The first rail apparatus 52 further includes a first rail 62 slidable within main guide rail 56 of first rail apparatus 52 and a first auxiliary rail 64 slidable within first rail 62. Stops on first rail 62 and first auxiliary rail 64 limits the travel of first rail 62 relative to main guide rail 56 on first rail apparatus 52 and the travel of first auxiliary rail 64 relative to first rail 62.

The second rail apparatus 54 further includes a second rail 66 slidable within main guide rail 56 of second rail apparatus 54 and a second auxiliary rail 68 slidable within second rail 66. Stops (not shown) on second rail 66 and second auxiliary rail 68 limit the travel of second rail 66 relative to main guide rail 56 on second rail apparatus 54 and the travel of second auxiliary rail 68 relative to second rail 66.

As further shown, marking device 10 includes a paint spray apparatus 70 secured between first rail apparatus 52 and second rail apparatus 54. The paint spray apparatus 70 includes a spray support 72 releasably secured to main guide rails 56 of first rail apparatus 52 and second rail apparatus 54. Spray support 72 has a nozzle retaining collar 74 at least partially surrounding a spray nozzle 76. As shown, attachment of spray support 72 to main guide rails 56 is preferably accomplished by bolts 78 extending through spray support 72 and first auxiliary rail 64 and second auxiliary rail 68. Tightening of corresponding nuts 80 on bolts 78 releasably secures spray support 72 to first rail apparatus 52 and second rail apparatus 54.

The paint spray apparatus 70 further includes a spray system 82 secured to spray support 72. The spray system 82 includes a flexible conduit such as hose 84 connected between a spray nozzle 76 and paint supply 18. Squeezing of a spray control handle 88 accomplishes activation of spray nozzle 76. Upon squeezing of spray handle 88, pressurized paint from the paint supply 18 travels through hose 84 and out of spray nozzle 76 onto surface 12 thereby forming a hash mark 11, as is described in further detail below.

In addition, in preferred usage of the hash marker device of the present invention, the first rail apparatus 52 and second rail apparatus 54 have a travel distance of approximately twenty-four (24") inches. This allows spray system 82 for paint spray apparatus 70 to travel the appropriate length to create an appropriate hash mark 11 on surface 12.

In addition, as shown in FIG. 1, in preferred marking device systems 10 a line guide 90 is included for determining the spacing between adjacent hash marks 11. in the embodiment shown line guide 90 includes a first guide member 92 having a first end 94 and a second end 96 and a second guide member 98 having a first end 100 and a second end 102, with the first end 94 of the first guide member 92 releasably and rotatably secured to the second cross member 44 of the support member 40 and the first end 100 of the second guide member 98 releasably and rotatably secured to the second end 96 of the first guide member 92. Preferably, the total length of line guide 90 is thirty-six (36") inches allowing marking device 10 to create appropriately spaced hash marks 11, as will be described in further detail below.

The first guide member 92 and the second guide member 98 of line guide 92 are rotatable relative to each other and support member 40 allowing line guide 92 to be folded into a smaller configuration when not in use. A guide chain 104 freely hangs from the second end 102 of the second guide member 98 in a general direction toward the surface 12 when the line guide 92 is unfolded.

The marking of hash marks 11 using the marking device 10 of the present invention will now be discussed. It will be understood by those persons skilled in the art that the marking of hash marks 11 described herein is only one method and that other methods of marking hash marks 11 is within the scope of the present invention.

First, the appropriate distance from the sideline of a football field is marked with a string or the like (not shown) for the length of the filed. For professional and college fields, this would be four (4") inches from the sideline. Next, spray nozzle 76 of spray system 82 of the paint spray apparatus 70 is positioned in the far right position. Then, spray nozzle 76 height is adjusted such that marking device 10 will create a four (4") inch wide hash mark 11. This is accomplished by removing nuts and bolts 50 securing support member 40 to frame member 28, moving support member 40 relative to frame member 28, reinserting bolts 50 through apertures 48, and tightening the nuts thereon. The height of spray nozzle 76 can also be adjusted within nozzle retaining collar 74 by loosening a set screw on nozzle retaining collar 74, adjusting the height, and retightening the set screw. It is suggested that adjustment of spray nozzle 76 height by either of these methods is done off the field of play to minimize stray paint marks on surface 12.

Next, line guide 90 is unfolded into the layout position with guide chain 104 hanging in a general direction toward surface 12. The field marking machine 14 is positioned with guide chain 104 of line guide 90 hanging directly over the forward edge of the goal line and the center of spray nozzle 76 over string. With field marking machine 14 powered, a ball valve (not shown) on field marking machine 14 is opened. Squeezing spray handle 88 on spray system 82 allows pressurized paint from the paint supply 18 to travel through hose 18 and out of spray nozzle 76. By moving spray system 82 to left, a twenty-four (24") inch hash mark 11 is created on surface 12. The spray system 82, with spray handle 88 still activated, can be moved back and forth until a desired hash mark 11 is created.

The field marking machine 14 is then moved forward to a position such that guide chain 104 is now hanging over the forward edge of previously painted hash mark 11. The above procedure can be repeated to create next hash mark 11. By following this process, perfect hash marks 11 which are four (4") inches wide and thirty-six (36") inches apart are created along the entire length of the field.

It is therefore seen that the present invention provides a device for accurately, precisely and reproducibly applying hash marks to a football field playing surface, which device requires only a single person to accurately place two or more hash marks in their required location. The present invention also provides methods by which a single person may easily and accurately use such a device to coat hash marks on a football field surface.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

I claim:

1. An auxiliary paint marking device for use with a field line marking machine that includes a paint supply, said auxiliary marking device serving to accurately, precisely and reproducibly apply discrete painted marks to a surface of a playing field, said auxiliary marking device including in combination:

a frame member, said frame member having a length dimension and being attachable to a field line marking machine that includes a paint supply;

guide system means carried by said frame member, said guide system means having a length dimension and being oriented in a substantially horizontal position on said frame member adjacent to any to-be-marked playing field surface; said guide system means including a first position indicator and a second position indicator on said guide system means;

field paint coating means carried by said frame member, said field paint coating means being carried by said frame and remote from said field line marking machine for movement along said guide system means, said field paint coating means including means for operative communication with a paint supply carried by a field line marking machine to which said frame is attached, field paint coating means being capable of accurately, precisely and reproducibly applying discrete painted marks to a field playing surface, wherein said field paint coating means is slidably secured to said guide system means for controlled movement over a predetermined length from said first position indicator on said guide system means to said second position indicator on said guide system means, the distance between said first and second position indicators on said guide system means corresponding to the length of a discrete painted mark that is to be reproducibly applied to a field playing surface.

2. The auxiliary marking device of claim 1 wherein said field paint coating means includes a spray nozzle.

3. The auxiliary marking device of claim 1 wherein said field paint coating means includes a control switch for controllably activating and stopping the flow of paint from said field paint coating means on to a field playing surface.

4. The auxiliary marking device of claim 1 wherein said field paint coating means includes a handle for moving said field paint coating means between said first and second position indicators on said guide system means.

5. The auxiliary marking device of claim 1 wherein said field paint coating means includes a handle for moving said field paint coating means between said first and second position indicators on said guide system means and a control switch for controllably activating and stopping the flow of paint from said field paint coating means on to a field playing surface, said handle and said control switch being located in positions such that they may both be operated and moved simultaneously.

6. The auxiliary marking device of claim 1 wherein said flame member and its associated guide means and said field paint coating means of said auxiliary marking device is releasably securable to a field line marking machine.

7. The auxiliary marking device of claim 1 wherein said guide system means is of a predetermined length and at a predetermined position for use in accurately, precisely and reproducibly applying marks of a predetermined length and at a predetermined position on the surface of a playing field.

8. The auxiliary marking device of claim 1 wherein there is included means for controlling the width of a to-be-painted mark.

9. The auxiliary marking device of claim 1 wherein said means for controlling the width of a to-be-painted mark includes means for adjusting the height of said field paint coating apparatus relative to said frame member for controlling the width of to-be-painted marks.

10. The auxiliary marking device of claim 9 wherein said auxiliary marking device is designed to produce a football hash mark, and wherein said guide system means has a length dimension of about twenty-four inches in length, and said means for controlling the width of a to-be-painted hash marks is set to produce hash mark of about four inches in width; whereby, said auxiliary football hash marking device may serve to accurately, precisely and reproducibly apply painted hash marks to a surface of a football playing field.

11. The device of claim 10 wherein said auxiliary marking device is designed to produce a football playing field hash mark, and carries a guide of a given length used to determine the spacing between adjacent hash marks; whereby, after said auxiliary marking device paints a hash mark at a correct location, said field line marking machine may be caused to travel from that hash mark position to a next hash mark position based on said guide of a given length to paint another accurately positioned hash mark, and so on as desired with the result that two or more hash marks will be precisely located and accurately painted.

12. The auxiliary marking device of claim 10 wherein said auxiliary marking device is designed to produce a football hash mark, and wherein said guide system means carries a hash mark spacing guide settable to length dimension of about thirty-six inches for use in determining the spacing between adjacent hash marks; whereby, after said auxiliary hash marking device paints a hash mark at a correct location, said field line marking machine may be caused to travel from that hash mark position to a next hash mark position based on said hash mark spacing guide to paint another accurately positioned hash mark, and so on as desired with the result that two or more adjacent hash marks will be precisely located and accurately painted on the surface of a playing field.

13. An auxiliary paint marking device for use with a field line marking machine that includes a paint supply, means for pressurizing any paint in any paint supply, a handle for steering the field marking machine, and wheels for allowing easy movement of such a field marking machine along a to-be-marked surface, said auxiliary marking device serving to accurately, precisely and reproducibly apply painted hash marks to a surface of a playing field, said auxiliary marking device including in combination:

a flame member, said flame member having a length dimension and being attachable to a field line marking machine that includes a paint supply;

guide system means carried by said frame member, said guide system means having a length dimension and being oriented in a substantially horizontal position on said frame member above and out of contact with any to-be-marked playing field surface, said guide rail system including first and second prepositioned stops;

field paint coating means releasably securable carried by said frame member, said field paint coating means being carried by said frame for movement along said guide system means, said field paint coating means including paint transfer means for transferring paint from any paint supply carried by any field line marking machine to which said frame is attached, wherein said field paint coating means includes a spray nozzle for accurately, precisely and reproducibly applying hash marks to a field playing surface; wherein said field paint coating means carried is slidably secured to said guide system means for controlled movement over a predetermined length from a first prepositioned stop on said guide system means to a second prepositioned stop on said guide system means, the distance between said first and second stop on said guide system means corresponding to the length of a hash mark that is to be reproducibly applied to a field playing surface;

a control switch for controllably activating and stopping the flow of paint from said field paint coating means on to a field playing surface a handle for moving said field paint coating means between said first and second position of said guide system means, said handle and said control switch being located in positions such that they may both be operated and moved simultaneously;

means for controlling the width of a to-be-painted hash marks; whereby, said auxiliary marking device may serve to accurately, precisely and reproducibly apply painted hash marks to a surface of a playing field.

14. The auxiliary marking device of claim 13 wherein said auxiliary marking device is designed to produce a football hash mark, and wherein said guide system means has a length dimension of about twenty-four inches in length, and said means for controlling the width of a to-be-painted hash marks is set to produce hash mark of about four inches in width; whereby, said auxiliary football hash marking device may serve to accurately, precisely and reproducibly apply painted hash marks to a surface of a football playing field.

15. The auxiliary marking device of claim 14 wherein said auxiliary marking device is designed to produce a football hash mark, and wherein said guide system means carries a hash mark spacing guide settable to length dimension of about thirty-six inches for use in determining the spacing between adjacent hash marks; whereby, after said auxiliary hash marking device paints a hash mark at a correct location, said field line marking machine may be caused to travel from that hash mark position to a next hash mark position based on said hash mark spacing guide to paint another accurately positioned hash mark, and so on as desired with the result that two or more adjacent hash marks will be precisely located and accurately painted on the surface of a playing field.

16. An auxiliary paint marking device, said auxiliary marking device serving to accurately, precisely and reproducibly apply painted hash marks to a surface of a football playing field, said auxiliary marking device including in combination:

a primary frame;

a paint supply carried by said primary frame;

means for pressurizing any paint in any paint supply;

a handle for steering said auxiliary field marking machine, wheels carried by said primary frame for allowing easy movement of such a field marking machine along a to-be-marked surface;

a secondary flame member, said frame member having a length dimension and being attachable to a field line marking machine that includes a paint supply;

guide system means carried by said frame member, said guide system means having a length dimension and being oriented in a substantially horizontal position on said frame member above and out of contact with any to-be-marked football playing field surface, said guide rail system including first and second prepositioned stops;

field paint coating means releasably securable carried by said frame member, said field paint coating means being carried by said frame for movement along said guide system means, said field paint coating means including paint transfer means for transferring paint from any paint supply carried by any field line marking machine to which said secondary frame is attached, wherein said field paint coating means includes a spray nozzle for accurately, precisely and reproducibly applying hash marks to a field football playing surface; wherein said field paint coating means carried is slidably secured to said guide system means for controlled movement over a predetermined length from a first prepositioned stop on said guide system means to a second prepositioned stop on said guide system means, the distance between said first and second prepositioned stops on said guide system means corresponding to the length of a mark that is to be reproducibly applied to a football field playing surface;

a control switch for controllably activating and stopping the flow of paint from said field paint coating means on to a football field playing surface a handle for moving said field paint coating means between said first and second position of said guide system means, said handle and said control switch being located in positions such that they may both be operated and moved simultaneously;

means for controlling the width of a to-be-painted hash marks; whereby, said auxiliary marking device may serve to accurately, precisely and reproducibly apply painted hash marks to a playing surface of a foot ball playing field.

17. A method for accurately, precisely and reproducibly apply painted marks to a surface of a football playing field having sidelines using the movable auxiliary marking device of claim 16, and including the steps of:

placing paint in a paint supply carried by said primary frame;

pressurizing paint in such paint supply to move paint from the paint supply to the field paint coating apparatus;

using the means for controlling the width of a to-be-painted hash marks to produce a hash mark of about four inches in width;

providing linear line-up guide indicia for the lateral location of hash marks from the sidelines on the surface of a football playing field;

using the handle and wheels to move the movable auxiliary marking device to a predetermined location of the line-up guide with the field paint coating means positioned at the line-up guide in the far right or left position;

simultaneously activating the control switch for controllably activating and stopping the flow of paint from said field paint coating and moving said handle for field paint coating means between said first and second prepositioned stops of said guide system means one or more times to produce a desired hash mark which is twenty-four (24") inch long and four (4") inches wide is accurately, precisely and reproducibly created, and then releasing said control switch and handle.

18. The method of claim 17 wherein the process is carried out by a single person.

19. The method of claim 17 wherein after a hash mark is created, said hash mark spacing guide is set to a length dimension of about thirty-six inches (36") for use in determining the spacing between adjacent hash marks; whereby, after a hash mark is painted at a correct location, then said field line marking machine is caused to travel from that hash mark position to a next hash mark position along the linear line-up guide indicia based on said hash mark spacing guide, and then another twenty-four (24") inch long and four (4") inches wide hash mark may be painted, and so on as desired with the result that two or more adjacent hash marks will be precisely located about thirty-six inches (36") apart and accurately painted on the surface of a football playing field, and whereby hash mars may be created along the entire length of the football playing field.

20. The method of claim 17 wherein the process is carried out by a single person.

* * * * *